United States Patent [19]

Riffe

[11] Patent Number: 4,928,503

[45] Date of Patent: May 29, 1990

[54] SCROLL APPARATUS WITH PRESSURE REGULATION

[75] Inventor: Delmar R. Riffe, La Crosse, Wis.

[73] Assignee: American Standard Inc., New York, N.Y.

[21] Appl. No.: 219,127

[22] Filed: Jul. 15, 1988

[51] Int. Cl.[5] ..... F04C 18/04; F04C 29/02; F04C 29/10

[52] U.S. Cl. ..... 62/498; 418/55; 418/57; 418/100; 418/188; 418/DIG. 1; 251/61.2

[58] Field of Search ..... 418/55 C, 55 D, 55 E, 418/57, 100, 188, DIG. 1; 137/500, 501; 251/61, 61.2; 62/498

[56] References Cited

U.S. PATENT DOCUMENTS

| | | | |
|---|---|---|---|
| 3,902,695 | 9/1975 | Worwetz | 251/61.2 |
| 4,216,661 | 8/1980 | Tojo et al. | 62/505 |
| 4,395,205 | 7/1983 | McCullough | 418/55 |
| 4,435,137 | 3/1984 | Terauchi | 418/55 D |
| 4,496,296 | 1/1985 | Arai et al. | 418/55 |
| 4,522,575 | 6/1985 | Tischer et al. | 418/57 |
| 4,551,082 | 11/1985 | Hazaki et al. | 418/55 |
| 4,552,518 | 11/1985 | Utter | 418/55 E |
| 4,642,034 | 2/1987 | Terauchi | 417/295 |
| 4,669,962 | 6/1987 | Mizuno et al. | 418/55 |
| 4,732,544 | 3/1988 | Kurosawa et al. | 417/222 |
| 4,743,181 | 5/1988 | Murayama et al. | 418/55 C |

FOREIGN PATENT DOCUMENTS

| | | | |
|---|---|---|---|
| 57-68579 | 4/1982 | Japan | 418/57 |
| 59-119090 | 7/1984 | Japan | 418/55 E |
| 60-166781 | 8/1985 | Japan | 418/55 D |
| 60-224988 | 11/1985 | Japan | 418/55 D |
| 60-228787 | 11/1985 | Japan | 418/55 D |
| 62-139991 | 6/1987 | Japan | 418/55 D |
| 920837 | 3/1963 | United Kingdom | 137/501 |

*Primary Examiner*—John J. Vrablik

*Attorney, Agent, or Firm*—William J. Beres; David L. Polsley; William O'Driscoll

[57] ABSTRACT

In a scroll compression apparatus having an orbiting scroll, a frame with a pressure regulation chamber adjacent the orbiting scroll wherein the frame includes a spring biased annular seal and a pressure responsive device in a discharge aperture through the frame for maintaining constant pressure in the pressure regulation chamber. Preferably, the frame includes an annular groove of rectangular cross-section accommodating a relatively smaller annular seal also of rectangular cross-section. An annular seal spring having a first planar surface and a second planar surface is disposed in the annular channel to bias the annular seal. The pressure responsive device has a first element exposed to discharge fluid pressure and a second element exposed to fluid at suction pressure such that the pressure differential serves to operate a piston for increasing or decreasing the flow area of the discharge aperture from the pressure regulation chamber.

43 Claims, 4 Drawing Sheets

FIG. 3
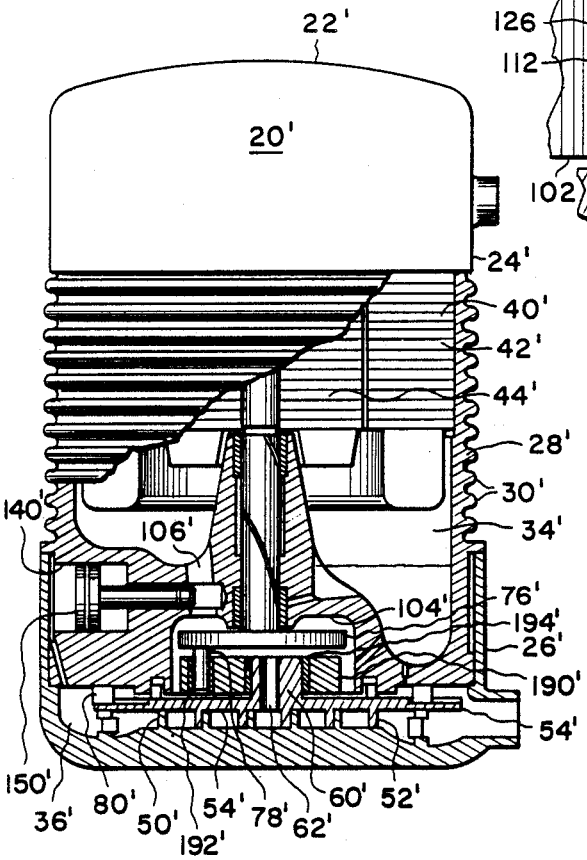
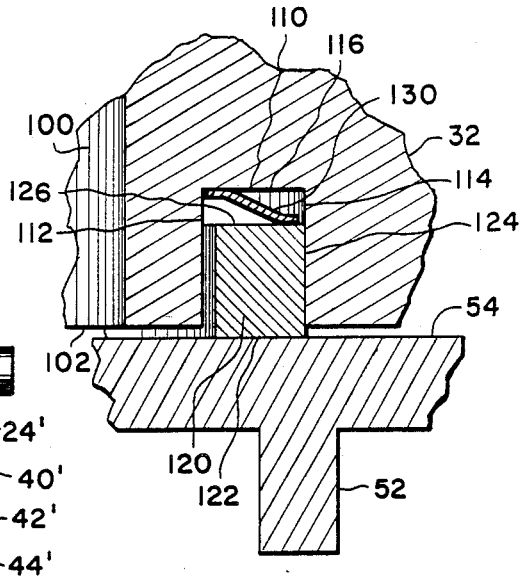
FIG. 4
FIG. 7
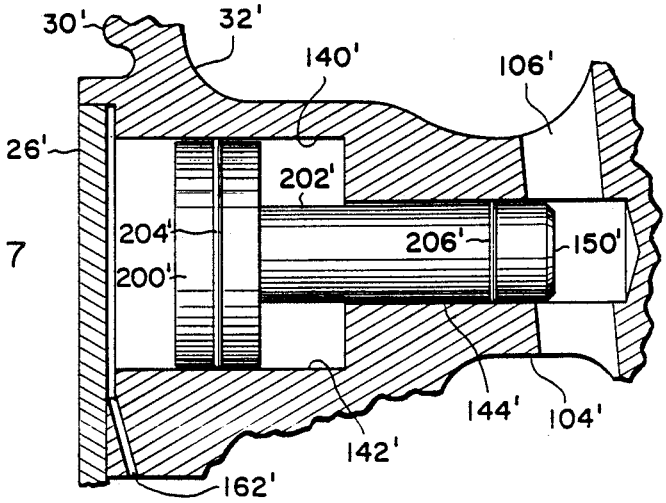

FIG. 10
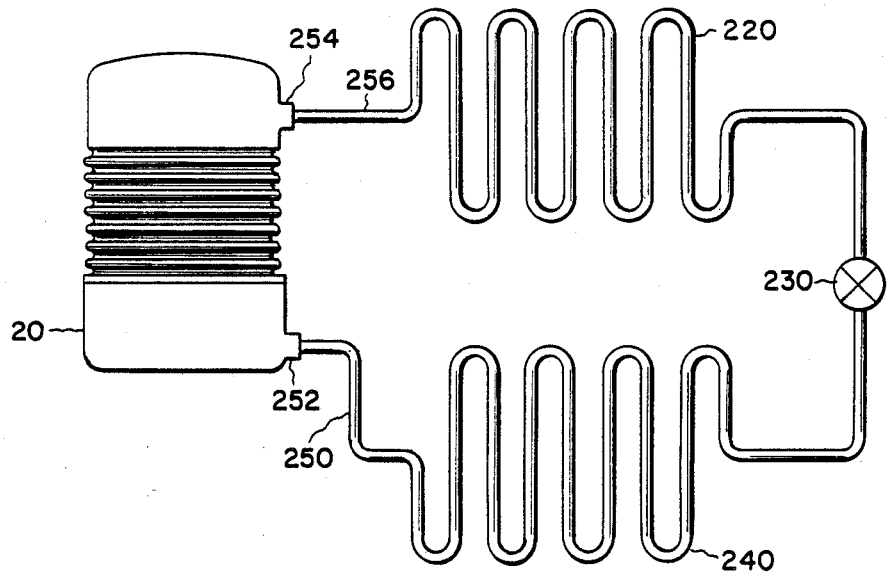
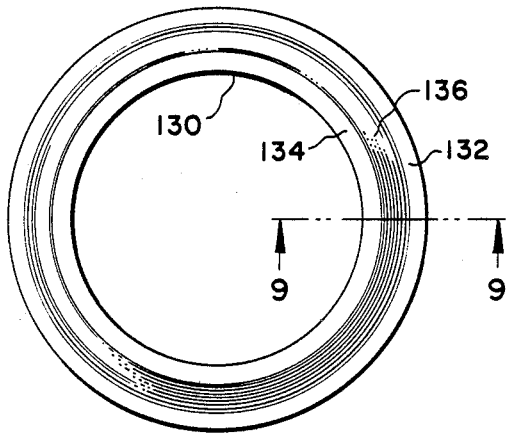
FIG. 8
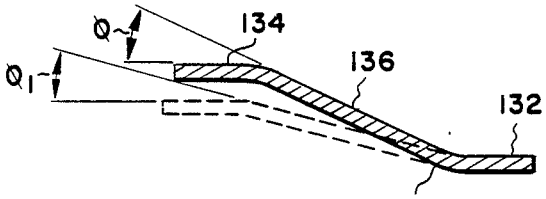
FIG. 9

SCROLL APPARATUS WITH PRESSURE REGULATION

TECHNICAL FIELD

This invention generally pertains to scroll compressor apparatus and more specifically relates to a constant pressure regulation means for fluid pressure balancing of the orbiting scroll.

BACKGROUND ART

In a typical scroll compression apparatus, two interfitting involute scroll wraps are provided for forming a plurality of chambers moving from the radial outer ends of the scroll wraps to the radial inner ends of the scroll wraps. The chambers are formed by a plurality of moving line contacts generated between the flanks of the scroll wrap elements, with the tip of each respective scroll wrap element in sliding engagement with the end plate of the opposing scroll element. In operation, one scroll wrap orbits with respect to the other scroll wrap, causing the formation of a chamber at the radial exterior end into which fluid is drawn and compressed as the chamber grows smaller in volume toward the center of the scroll wraps. The compressed fluid is then discharged through an aperture centrally disposed in at least one of the end plates of the scroll wraps. Each chamber therefore discharges a pulse of compressed fluid, such that the output of compressed fluid from the scroll apparatus is pulsating in manner.

However, in order to maintain the desired pressure between the respective tips and end plates of the scroll wraps to minimize leakage therebetween, it has been found desirable to apply fluid at discharge pressure to act upon at least one of the scroll wrap end plates on the side opposite from the scroll wrap. The area to which the discharge pressure fluid is applied generally determines the pressure applied to the scroll wrap tips.

It has been found difficult to maintain the appropriate pressure due to variations in discharge pressure.

The discharge pressure varies in response to varying load conditions of the system in which the scroll compression apparatus is used. For example, in a refrigeration system the load experienced by the scroll compression apparatus is the flow of refrigerant fluid to be compressed. This flow varies in response to environmental temperature changes experienced by the condenser and evaporator, changes in refrigerant flow rate through the expansion valve, changes in the refrigeration system controller and other factors.

Furthermore, it is also desirable to minimize the effects of the occasional fluctuations in the suction pressure of the fluid to be compressed. When the suction pressure of the fluid is relatively higher or lower, it would be desirable to obtain a corresponding slight compensatory increase or reduction in the pressure exerted between the scrolls. Typically, no provision is made for these fluctuations.

Another problem often encountered in the typical pressure balanced scroll compression apparatus is leakage of fluid at discharge pressure to the area containing fluid at suction pressure. Not only does this leakage make difficult the maintenance of the appropriate pressure in the compressor apparatus, but any such fluid must be recompressed, reducing the useful work output of the scroll compression apparatus. Typical compressor apparatus utilize an elastomeric seal to minimize this leakage, however, the elastomeric seal is typically too inflexible to absorb any substantial axial movement of the scroll end plate due, for example, to slugging of fluid through the scroll wraps.

Therefore, it is an object of the present invention to provide a regulated pressure in a discharge pressure balanced scroll compression apparatus.

It is a further object of the subject invention to provide an improved sealing means for improving the efficiency of such a pressure balanced scroll compression apparatus.

It is yet a further object of the invention to provide an apparatus for regulating the discharge pressure balancing in such an apparatus.

It is yet a still further object of the present invention to provide such a pressure regulation device as will react to fluctuations in suction pressure.

It is a still further object of the invention to provide such an improved compression apparatus which is inexpensive to maintain and operate.

Yet a still further object is to provide such an apparatus which is self-contained and self-governing.

These and other objects of the invention will be apparent from the attached drawings and the description of the preferred embodiment that follows hereinbelow.

SUMMARY OF THE INVENTION

The subject invention is a pressure regulating device responsive to suction pressure and discharge pressure and a biased annular seal for maintaining a regulated discharge pressure in a discharge chamber of a scroll compression apparatus having a pressure balanced scroll element. The pressure regulating device consists of a piston inserted in a bore so as to increase and decrease the size of the discharge aperture from the discharge pressure chamber in response to a first, inner end plate subject to discharge pressure and a second, outer end plate subject to suction pressure. Preferably, a first bellows is connected to the first end plate and a second bellows is connected to the second end plate and are disposed circular bellows concentrically, having a volume at vacuum or near-vacuum pressure between the bellows.

The annular seal is preferably formed of elastomeric material having a rectangular cross-section. The scroll compression apparatus further comprises a frame for defining the discharge pressure chamber. An annular groove having a rectangular cross-section is defined in the frame at a point which is radially outside the circumference of the discharge pressure chamber. The groove is sized to accommodate the seal and to permit its free movement in the groove. An annular spring is disposed within the groove for biasing the annular seal out of the groove, whereby the annular seal is forced into contact with a scroll wrap end plate to minimize the fluid leakage and maintain discharge pressure in the discharge chamber.

BRIEF DESCRIPTION OF THE DRAWINGS

FIG. 3 shows a partial cross-section of a hermetic scroll compressor including an alternative embodiment of the subject invention.

FIG. 4 shows an enlarged cross-section of the annular seal and annular spring of the present invention.

FIG. 7 shows an enlarged cross-sectional view of the alternative embodiment of the pressure regulating device portion of the subject invention as shown in FIGS. 3 and 5.

FIG. 8 shows the annular seal spring of the present invention.

FIG. 9 shows a cross-sectional view of the annular spring of FIG. 8 taken along section line 9—9.

FIG. 10 shows a schematic representation of an air conditioning system embodying the subject invention.

DESCRIPTION OF THE PREFERRED EMBODIMENT

Figure 1:
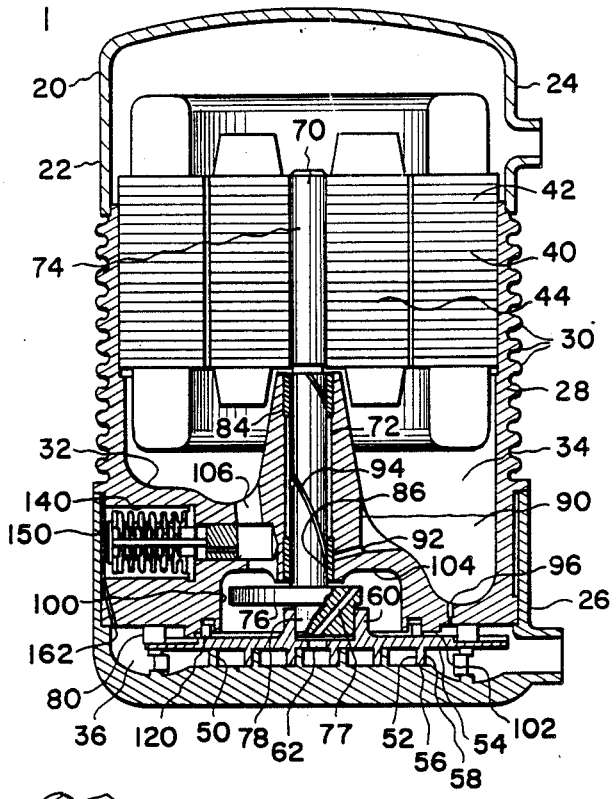
FIG. 1 shows cross-sectional view of a hermetic scroll compressor apparatus embodying the pressure regulating device and seal of the present invention.
Figure 2:
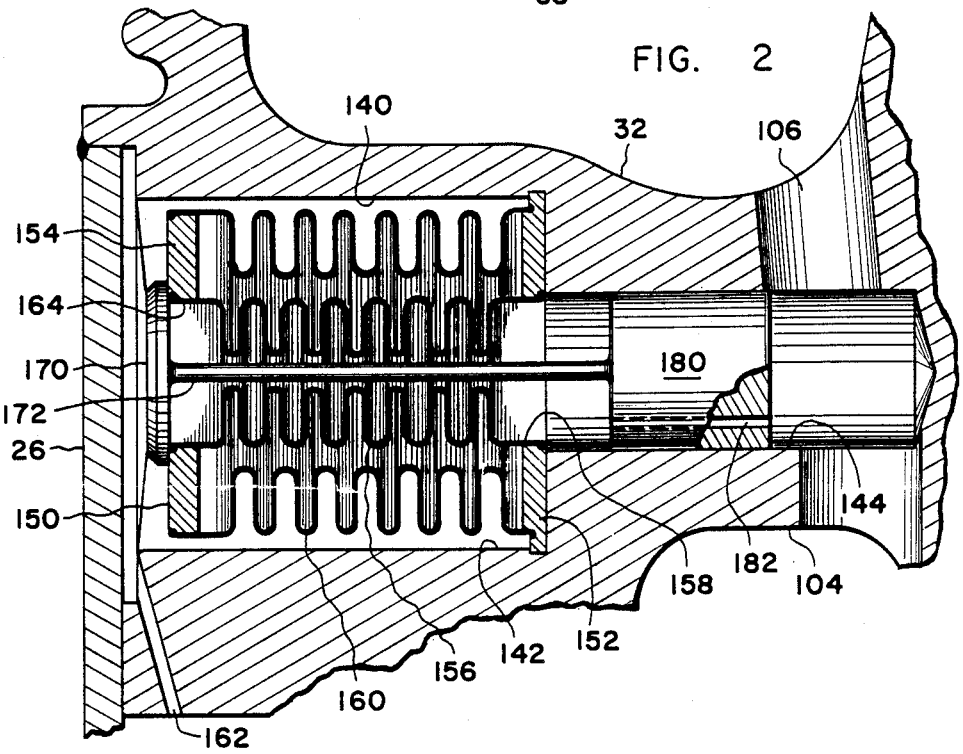
FIG. 2 shows an enlarged cross-sectional view of the preferred embodiment of the pressure regulating device of the subject invention.

A compressor system generally denoted by reference numeral 20 is shown in FIG. 1. Compressor system 20 is a rotary compressor, housed in a hermetic shell 22. Preferably, the hermetic shell is generally cylindrical, comprised of an upper portion 24, a lower portion 26 and a central portion 28. The central portion 28 includes a peripheral heat exchange portion comprised of a plurality of spaced, parallel annular ribs 30 for providing heat exchange from the interior of the hermetic shell 22 to the exterior environment. The central portion 28 of the hermetic shell 22 also includes a frame portion 32 for separating the hermetic shell 22 into a discharge pressure portion 34 and a suction pressure portion 36.

The central portion 28 preferably is secured by welding to the upper portion 24 and the lower portion 26 such that the shell 22 is suitably divided into the discharge and suction pressure portions.

A motor 40 is disposed in the discharge pressure portion 34 of the hermetic shell 22 supported by the central frame 32. The motor 40 is prferably an electric motor having a fixed stator 42 and a rotatable rotor 44 separated by an annular space. The motor is not described in detail, as it is believed that the art of the electric motor is generally well understood. However, the motor 40 would generally preferably be an electric motor operating on single or three-phase alternating current. It would also be possible to operate the compressor assembly 20 as a variable speed device by including a suitable electric motor 40 or a suitable controller (not shown) for varying the speed of the motor 40.

The compressor assembly 20 is preferably a scroll-type compressor of the type having one fixed scroll wrap 50 and one relative orbiting scroll wrap 52. However, from the description of the preferred embodiment that follows herein, it will be apparent to those skilled in the art that the subject invention could be readily modified for application to a co-rotation scroll compressor in which both scroll wraps 50 and 52 are rotated about parallel, non-concentric axes. In the compressor assembly 20, the fixed scroll wrap 50 is affixed to or formed as part of the lower hermetic shell portion 26 such that a portion of the lower hermetic shell portion 26 comprises a substantially planar surface acting as a second scroll end plate for sealing orbital engagement with the orbiting scroll wrap 52. The orbiting scroll wrap 52 is secured to or formed as part of an orbiting end plate 54.

The fixed scroll wrap 50 and the orbiting scroll wrap 52 are upstanding involutes generated from parallel axes. Each respective scroll wrap 50 and 52 has a radially inner end, a radially outer end, a tip 56 for sealingly engaging the opposing end plate and flank surfaces 58 for sealing line contact engagement with the flank surface 58 of the adjacent scroll wrap all as is generally known in the art.

The orbiting scroll end plate 54 also includes a circular drive stub 60 disposed opposite from the orbiting scroll srap 52. Drive stub 60 is preferably cast as an integral part of the end plate 54, and located approximately in the center of the end plate 54. A discharge port aperture 62 is defined through the end plate 54 and the drive stub 60 by a bore adjacent the inner radial end of the orbiting scroll wrap 52. This discharge port aperture 62 permits fluid communication from the scroll wraps 50 and 52 when fluid is compressed therein.

A drive shaft 70 is disposed within the hermetic shell 22. The drive shaft 70 extends through a frame aperture 72 in the central frame portion 32. This frame aperture 72 is substantially centrally located in the frame portion 32 so that the drive shaft 70 communicates between the discharge pressure portion 34 and the suction pressure portion 36. The drive shaft 70 has an upper end 74 which is in driving connection with the motor 40, by means of a press fit between the rotor 44 and the upper end 74 or by means of a common key and juxtaposed keyways in the rotor 44 and upper end 74 (not shown).

A lower end of the drive shaft 70 is comprised of a crank portion 76 disposed in the suction pressure portion 36. The crank portion 76 includes an eccentric crankshaft member, crank stub 78, which is a cylindrical projection from the crank portion 76 on an axis parallel to the axis of the drive shaft 70. An integral counterweight is included in the crank portion 76 to dynamically balance the drive shaft 70 during operation. The crank stub 78 is in rotational engagement with the drive stub 60 for transmitting rotational motion to the orbiting scroll end plate 54. An Oldham coupling 80 or similar anti-rotation device is included in the suction pressure portion 36 of the compressor assembly 20 for preventing rotation of the orbiting scroll end plate 54 while translating the rotational motion into a relative orbital motion. Anti-rotation devices such as the Oldham coupling 80 are believed to be generally well understood in the art and are not disclosed in detail herein, as a detailed understanding of such devices is not believed necessary to the comprehension of the subject invention.

An upper radial bearing 84 and a lower radial bearing 86 is disposed in the frame aperture 72 for rotational engagement with the drive shaft 70. These bearings 84 and 86 may be sleeve bearings formed, for example, of sintered bronze, or may be roller or ball bearings.

In order to provide satisfactory lubrication for the bearings 84 and 86, the central frame portion 32 includes a depression defining a lubricant reservoir 90. A lubricant passage 92 is defined by a bore extending through the central frame portion 32 between the lubricant reservoir 90 and the lower radial bearing 86, providing for lubricant passage to the lower radial bearing 86. A helical groove 94 extends along drive shaft 70 between the lower radial bearing 86 and the upper radial bearing 84 to transmit lubricant from the lower radial bearing 86 to the upper radial bearing 84. Finally, a metering passage 96 is defined by a bore between the lubricant reservoir 90 and the suction pressure portion 36 for transmitting a measured quantity of lubricant to the suction pressure portion 36 to be entrained with the fluid to be compressed so that the Oldham coupling 80 and the scroll wraps 50 and 52 will receive adequate lubrication.

A circular sidewall 100 generally concentric with the frame aperture 72 defines a recess in the central frame portion 32 wherein the crank portion 76 of the drive shaft 70 is received for free rotation. A planar lower face 102 is provided on the central frame portion 32 in a spaced relationship with respect to the orbiting scroll end plate 54. Preferably, the lower face 102 is disposed so as to not interfere with the free orbital motion of the orbiting scroll end plate 54, but rather is disposed in a range of 0.030 to 0.060 inches from the orbiting scroll end plate 54.

As shown in FIGS. 1, 3, 4, 5 and 6, an annular groove 110 is defined in the lower face 102 of the central frame portion 32. This annular groove 110 is defined by a circular interior side wall 112, a concentric exterior side wall 114 of relatively larger diameter and a recessed planar surface 116 in the base of the groove 110 adjoining the interior side wall 112 and the exterior side wall 114. The interior side wall 112 is spaced radially outward from the circular side wall 100. An annular seal 120 of rectangular cross-section is disposed within the annular groove 110. The annular seal 120 includes a first planar face 122 for engaging the orbiting scroll end plate 54 and a second, exterior surface 124 for engagement with the exterior side wall 114. The second surface 124 is normal to the plane of the first face 122. A third engagement face 126 is at the upper end of the second surface 124 and is parallel to the first face 122.

An annular seal spring 130 is disposed between the third face 126 of the annular seal 120 and the recessed surface 116 of the annular groove 110. The sealing spring 130, more particularly shown in FIGS. 8 and 9, is comprised of three portions; a first relatively planar radially exterior portion 132, a radially interior planar portion 134 and an angular portion 136 adjoining the exterior planar portion 132 with the interior portion 134. The exterior planar portion 132 and the interior planar portion 134 are parallel and spaced apart a distance determined by an angle theta of the angular portion 136. Preferably, the seal spring 130 is a solid annulus having no holes or discontinuities, as shown in FIG. 8. This contributes to the sealing efficiency of the combination of the seal 120 and seal spring 130 by causing the seal spring 130 to act as a a barrier to fluid flow. The seal spring 130 may be formed of spring steel by such means as die-press operations, for example.

The second surface 124 of the annular seal 120 is sized to a diameter slightly larger than the exterior side wall 114 of the annular groove 110 such that when the annular seal 120 is inserted into the annular groove 110, the second surface 124 is slightly compressed in contact with the exterior side wall 114. The annular sealing spring 130 is disposed between the annular seal 120 and the annular groove 110, with the interior planar portion 134 in contact with the recessed surface 116 and the exterior planar portion 132 in biasing contact with the third face 126 of the annular seal 120. When the compressor assembly 20 is assembled, the orbiting end plate 54 is pressed into engagement with the first face 122 of the annular seal 120, causing the angle theta of the angular portion 136 to move to the angle $theta_1$, so that the sealing spring 130 biases the annular seal 120 out of the groove and toward the orbiting scroll end plate 54 to ensure sealing contact therebetween. Thus, the circular side wall 100 and the orbiting scroll end plate 54 are sealed by the annular seal 120 to comprise a pressure regulation chamber at a regulated pressure which is normally at or substantially equal to the discharge pressure of the scroll apparatus 20. As previously described, the pressure regulation chamber is concentric with the drive means of the orbiting scroll wrap 52, as shown in FIG. 1, since in the preferred embodiment the side wall 100 is circular and generated about the axis of the drive shaft 70. However, concentric should be understood in this context to include any pressure regulation chamber which is disposed generally equally about the axis of the drive shaft 70.

The circular side wall 100 is bounded opposite the lower face 102 by a top wall 104. A bore 106 defining a discharge regulation passage extends from the top wall 104 to the upper surface of the central frame portion 32.

A regulation device bore 140 intersects and is substantially normal to the regulation passage 106. The regulation device bore 140 extends from the radial exterior of the central frame portion toward the radial interior of the central frame portion 32, and has a first large diameter portion 142 and a small diameter portion 144 which intersects the regulation passage 106.

A pressure regulation device 150 is disposed in the regulation device bore 140. Preferably, the pressure regulation device 150 is comprised of an inner end plate 152, an outer end plate 154, and two interfitting pleated bellows elements. The first element, a pleated inner bellows 156, of relatively smaller diameter contains discharge pressure fluid in its interior, received through an orifice 158 in the inner end plate 152. The second element, pleated outer bellows 160 is of relatively larger diameter and is disposed concentrically around the inner bellows 156. The exterior of the second, outer bellows is exposed to fluid at suction pressure communicated to the large diameter portion 142 of the regulation device bore 140 through a transmission passage 162. The suction pressure transmission passage 162 is a relatively small bore extending from the large diameter portion 142 to the suction pressure portion 36 of the hermetic shell 22.

For ease of manufacture, the outer end plate 154 has a bore 164 defining an aperture equal in diameter to that of the inner end plate orifice 158. This permits the inner bellows 156 and the outer bellows 160, which are preferably formed of a thin, flexible material such as spring steel, to be secured to the inner end plate 152 and then secured to the outer end plate 154 by means of welding or brazing. An end cap 170 is then sealingly secured to the outer end plate 154 such that the bore 164 is thereby covered. A piston rod 172 extends from the end cap 170 through the interior of the inner bellows 156 and is secured to a piston 180 by such means as welding or threads in a correspondingly threaded aperture. These components of the pressure regulation device 150 would preferably be steel or a similar high strength metal so as to give the maximum service life and minimize maintenance requirements.

The piston 180 is disposed slidingly within the small diameter portion 144 of the regulation device bore 140 such that the piston 180 may be moved into and out of the regulation passage 106. In turn, this movement of the piston 180 decreases or increases the available flow area through the regulation passage 106. A small discharge pressure transmission bore 182 is provided through the piston 180 coaxial with the pressure regulation device bore 140 for transmission of discharge pressure fluid therethrough to the interior of the inner bellows 156 of the pressure regulation device 150.

In the operation of the compressor assembly 20, the motor 40 is actuated so that the rotor 44 rotates the drive shaft 70, which in turn actuates the orbiting scroll end plate 54 through the inner action of the crank stub 78 and the orbiting end plate drive stub 60. The orbiting scroll end plate is restrained from rotational motion into relative orbital motion by the Oldham coupling 80. As the orbiting scroll wrap 52 orbits the fixed scroll wrap 50, a plurality of compression chambers moving toward the radial inner end of the respective wraps are defined. The fluid to be compressed is drawn into the radial outer ends of the respective wraps and compressed in these chambers and discharged through the discharge port aperture 62 and the crank aperture 77 into the pressure regulation chamber defined by the circular side wall 100, the annular seal 120, the orbiting scroll end plate 54 and the top wall 104.

As the refrigerant or fluid is compressed, the discharge pressure fluid forces a small flow of lubricant through the lubricant metering aperture 96 and the lubricant passage 92. the lubricant entering the suction pressure portion 36 lubricates the Oldham coupling mechanism, any thrust bearings applied to the orbiting scroll end plate 54 and to the tip 56 and flank 58 surfaces of the respective scroll wraps. Lubricant forced through the lubricant passage 96 lubricates the lower radial bearing 86 and is transmitted by the drive shaft groove 94 from the bearing 86 to the upper radial bearing 84 and thence into the discharge pressure portion 34. The lubricating oil in the suction pressure portion 36 is entrained by the refrigerant or fluid being compressed and is forced through the discharge port aperture 62 and the regulation passage 106 into the discharge pressure portion 34 wherein it disentrains from the compressed fluid or refrigerant, as the case may be, and flows downwardly through the annular space between the stator 42 and rotor 44 into the lubricant reservoir 90.

Simultaneously, fluid at suction pressure is transmitted through the suction pressure transmission passage 162 to act upon the outer surface of the outer bellows 160 and through the discharge pressure transmission bore 182 in the piston 180 to act upon the inner surface of the inner bellows 156. As the respective bellows are restrained by the end plates 152 and 154 to act together, the outer end plate 154 is moved axially in the large diameter bore 142 by the pressure differential. Preferably, vacuum or near vacuum pressure is maintained in the variable volume void between the bellows 156 and 160.

In response to the pressure differential between suction pressure and discharge pressure, the piston 180 is moved into or out of the regulation passage 106 to decrease or increase the available flow area, such that an increase in discharge pressure will actuate the piston 180 to increase the available flow area and a relative decrease in discharge pressure will actuate the piston to decrease the flow area. The result of the piston actuation therefore causes the piston to act to increase the discharge pressure fluid retained in the chamber when the discharge pressure decreases and conversely to decrease the discharge pressure by allowing greater flow when the discharge pressure increases in the chamber. Therefore, the pressure of discharge fluid in the chamber remains substantially constant so that the discharge pressure balancing of the orbiting scroll end plate 54 does not undesirably fluctuate.

Additionally, the pressure regulation device is sensitive to variations in suction pressure. The relative pressure of the scroll wrap tips 56 upon the scroll end plate 54 is balanced by the actuation of the piston 180 to reduce the pressure of discharge fluid in the chamber when the suction pressure of the fluid in the suction pressure portion 36 decreases. Conversely, should an increase in suction pressure be experienced in the fluid to be compressed, the piston 180 will be actuated by the increased suction pressure to correspondingly increase the discharge pressure, maintaining the sealing between the scroll wraps 50 and 52. In examining FIG. 1, it will be apparent that fluid contained within the pressure regulating chamber exerts a force upon the back of the scroll end plate 54 within the area bounded by the annular seal element 120. This force acts to bias the orbiting scroll member toward the fixed scroll member formed by the lower hermetic shell portion 26 and wrap 50. This biasing force seals the chambers of the scroll wraps 50 and 52, acting against the commonly known separating forces due to fluid pressure within the scroll wraps 50 and 52. As noted above, the pressure regulation device is responsive to both discharge pressure and suction pressure, providing a substantially constant regulated pressure in the chamber at a given suction pressure and an increased or decreased regulated pressure at an increased or decreased suction pressure. In other words, the function of the pressure regulation device is to provide a pressure on the scroll end plate 54 which varies adaptively to variations in discharge and suction pressure.

Figure 5:
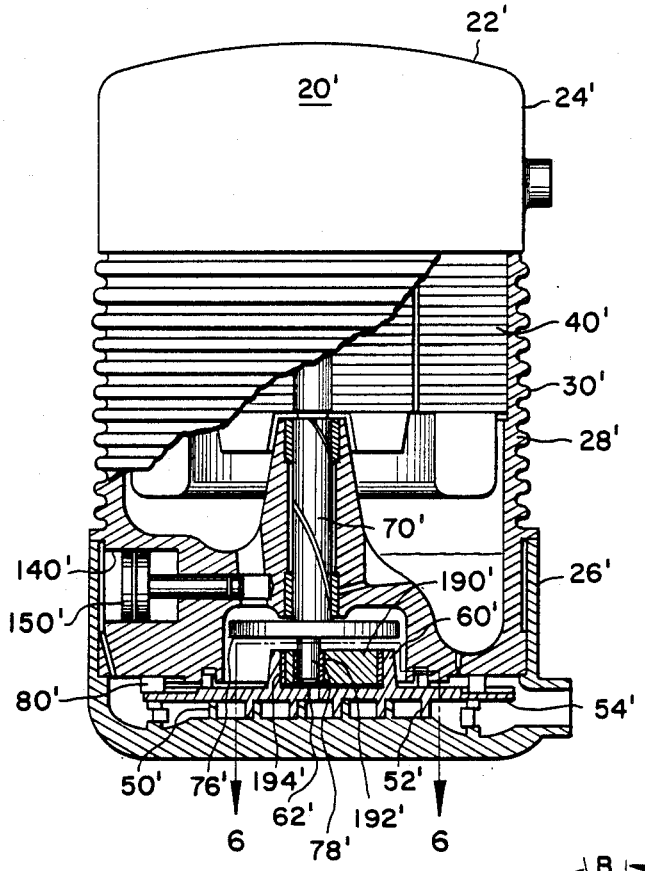
FIG. 5 shows a hermetic scroll compressor including an alternative embodiment of the present invention wherein the compressor includes an internal pivot swing link compliance member suitable for discharge to the pressure balance chamber.
Figure 6:
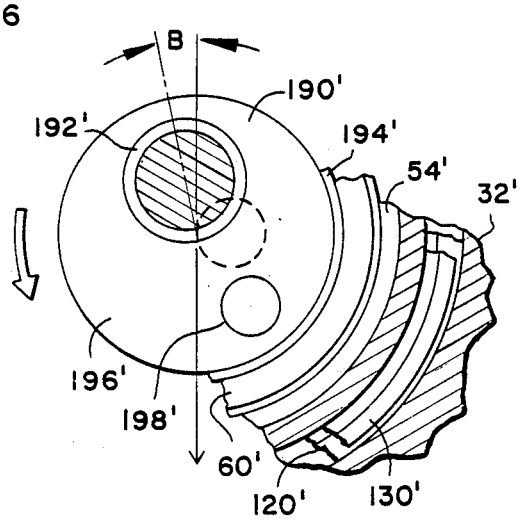
FIG. 6 shows an enlarged cross-sectional view of the compressor of FIG. 5 taken along section line 6—6.

Alternative embodiments of the subject invention are shown in FIGS. 3 through 7. In the alternative embodiments, the reference numerals are consistent with the preferred embodiment, with the addition of an apostrophe to denote the alternative embodiment. The compressor assembly 20' is shown in FIGS. 3 and 5 as including radially compliant drive means in the form of swing links 190', in addition to or in lieu of the axially compliant drive means.

In FIG. 3, the swing link 190' is shown in the external pivot configuration wherein the crank stub 78' engages a bearing 192' for rotationally driving the swing link 190'. The motion of the swing link 190' is translated through a drive stub bearing 194' to the drive stub 60' of the orbiting scroll end plate 54'. The swing link 190' has an upper face 196' which is relatively spaced with respect to the crank portion 76', to permit free flow of fluid at discharge pressure from the discharge port aperture 62'.

In FIG. 5, the swing link 190' is disclosed in an internal pivot configuration. As with the external configuration swing link 190', a crank bearing 192' engages the crank stub 78' at a drive angle B for translating rotational motion from the drive shaft 70' to the swing link 190'. The motion of the swing link 190' is then translated through a drive stub bearing 194' surrounding the circular exterior of the swing link 190' to an annular orbiting end plate drive stub 60', configured as an annular wall surrounding the swing link 190'. The swing link 190' is provided with a bore 198' to permit free flow of fluid from the discharge port aperture 62', and is further provided with an upper face 196' spaced relatively away from the crank portion 76' to permit free flow of discharge pressure fluid from the discharge port aperture 62' into the pressure regulation chamber.

These alternative embodiments of the compressor assembly 20' disclose an alternative embodiment of the pressure regulating device 150'. The pressure regulation device 150' is substantially T-shaped in cross-section, comprised of a first relatively large diameter section 200' and a relatively small diameter section 202'. The large diameter section 200' is disposed within the large diameter portion 142' of the regulation device bore 140' and is connected thereto in sliding, sealing engagement by an annular seal 204'. The small diameter section 202' is disposed within the small diameter portion 144' of the regulation device bore 140, and slidingly sealingly engages the small diameter portion 144' with a second seal 206'. The volume between the first seal 204' and the second seal 206' is substantially evacuated, maintained at a vacuum by the operation of the seals 204' and 206'.

Preferably, the seals 204' and 206' are formed of a flexible elastomeric material and seated in corresponding annular grooves in the pressure regulation device 150'. The pressure regulation device 150' would be a suitable metal, such as steel.

In operation, the pressure regulation device 150' is substantially identical to the operation of the pressure regulation device 150 in the preferred embodiment. This is due to the fact that the end of the large diameter section 200' is exposed to fluid at suction pressure and the end of the small diameter 202' is exposed to discharge pressure, creating the same response to changes in pressure as in the preferred embodiment. However, because of the difficulty in maintaining a perfect, theoretical seal with sealing elements 204' and 206', it is not believed practical to operate the pressure regulation device 150' without means for maintaining a vacuum in the volume between the seals 204' and 206'.

Preferably, the compressor assembly 20 or 20' would be utilized in a refrigeration or air conditioning system for circulating a refrigerant in closed loop connection, such a system having a condensor 220 for condensing refrigerant to a liquid form, an expansion valve 230 for receiving the liquid refrigerant from the condenser 220 and expanding the refrigerant, an evaporator 240 for receiving expanded refrigerant from the expansion valve 230 and evaporating the refrigerant, a suction line 250 for transferring the evaporated refrigerant to a suction port 252 in the lower portion 26 of the hermetic shell 22 such that the refrigerant is received in the suction pressure portion 36. The refrigerant is then compressed as described above and discharged from the compressor assembly 20 through a discharge port 254 and thence through a discharge line 256 to the condenser 220. A schematic representation of such a refrigeration or air conditioning system is shown in FIG. 10.

It will be apparent to those skilled in the art that such a refrigeration or air conditioning system could include multiple compressor assemblies 20 or 20', or multiple other components as well as additional refinements such as hot gas defrost, all as is generally known to those skilled in the art.

Thus, it can be readily seen that the subject invention can be readily applied to compressor assembly 20, even where the compressor assembly 20 includes a radially compliant swing link such as swing link 190' in the internal or external configuration. It can further be seen that the subject invention provides improved compressor performance by providing a proper balance of discharge pressure action upon the orbiting scroll end plate 54. The action of the pressure regulating device 150 is self regulating and does not require an external power source, thereby providing low maintenance costs and simple, automatic operation. It is also apparent that the annular seal of the subject invention provides a greater sealing efficiency of those of the prior art, which cooperates with the pressure regulation device 150 to further reduce the pressure variations in the pressure regulation chamber defined in the compressor assembly 20.

Modifications to the preferred embodiment of the subject invention will be apparent to those skilled in the art within the scope of the claims that follow hereinbelow.

What is claimed is:

1. A fluid compressor comprised of:

a first scroll member having an end plate, an upstanding involute wrap disclosed on said end plate, said first scroll member end plate further including a discharge aperture and a circular drive stub on said end plate;

a fixed second scroll member having an end plate and an upstanding involute wrap disclosed on said end plate for interleaving engagement with said upstanding involute wrap of said first scroll member;

means for driving said first scroll member, said drive means including a drive shaft having an eccentric crank portion and a crank portion for engaging said first scroll member drive stub;

a frame defining a pressure regulation chamber concentric with said drive means, said frame including a bore defining a pressure regulation passage and an aperture for flow communication from said chamber, said discharge aperture of said first scroll member end plate providing flow communication to said chamber;

a pressure regulation device for regulating fluid pressure in said pressure regulating chamber including a piston having a portion disposed in said pressure regulation passage, said pressure regulation device having a first element responsive to discharge pressure and a second element responsive to suction pressure;

an annular seal element disposed about said concentric chamber between said first scroll member end plate and said frame for sealing said chamber so that said regulated fluid pressure acts upon said first scroll end plate to bias said first scroll member toward said second scroll member; and means for biasing said annular seal toward said first scroll member end plate.

2. A fluid compressor comprised of:

a hermetic shell;

a first scroll member disposed in said hermetic shell, said first scroll member having an end plate having a discharge aperture, an upstanding involute portion disposed on said end plate, and a drive stub on said end plate;

a second scroll member fixed in said hermetic shell, said second scroll member having an end plate and an upstanding involute portion disposed on said end plate for interleaving engagement with said upstanding involute portion of said first scroll member;

means for compliantly driving said first scroll member, said compliant drive means including a drive shaft having an eccentric crank portion and a crank stub, and a link having an aperture for accepting said first scroll member drive stub and said crank stub;

a motor disposed in said hermetic shell, said motor engaging said compliant drive means;

a frame in said hermetic shell, said frame dividing said hermetic shell into a suction pressure portion and a discharge pressure portion, said frame and said first scroll member defining a chamber concentric with a portion of the drive shaft of said compliant drive means, said frame further defining an aperture for flow communication from said chamber to said discharge pressure portion;

means for regulating fluid pressure in said chamber, said pressure regulating means responsive to suction pressure and to discharge pressure;

an annular seal element disposed about said concentric chamber between said first scroll member end plate and said frame for sealing said chamber so that said regulated fluid pressure acts upon said first scroll end plate to bias said first scroll member toward said second scroll member; and means for biasing said annular seal toward said first scroll member end plate.

3. The fluid compressor as set forth in claim 2 wherein said fluid compressor further includes means for biasing said first scroll member comprised of an annular biasing member.

4. The fluid compressor as set forth in claim 3 wherein said annular biasing member is further comprised of a solid annular spring.

5. The fluid compressor as set forth in claim 4 wherein said frame further defines an annular groove for containing said annular spring and at least a portion of said annular seal element.

6. The fluid compressor as set forth in claim 5 wherein the frame is further operative to support a stator of the motor within said hermetic shell.

7. The fluid compressor as set forth in claim 6 wherein the frame further includes a lubricant reservoir.

8. The fluid compressor as set forth in claim 7 wherein the frame further includes a lubricant metering aperture for metering flow communication of a lubricant from said lubricant reservoir to said suction pressure portion wherein said lubricant is entrained with the fluid.

9. The fluid compressor as set forth in claim 8 wherein said motor includes a stator and a rotor defining an annular space in which the lubricant is disentrained from said fluid and through which the disentrained lubricant flows to said reservoir.

10. The fluid compressor as set forth in claim 9 wherein the frame further includes means for bearing rotational motion of said drive shaft.

11. The fluid compressor as set forth in claim 10 wherein the frame further includes a lubricant passage from said lubricant reservoir to said bearing means.

12. The fluid compressor as set forth in claim 11 wherein said pressure regulating means is further comprised of a piston movably disposed in said aperture in said frame for variably sizing said aperture to regulate the flow therethrough.

13. The fluid compressor as set forth in claim 12 wherein said piston is operably connected to a pressure differential responsive controller.

14. The fluid compressor as set forth in claim 13 wherein said pressure differential responsive controller is comprised of a first element responsive to discharge pressure and a second element responsive to suction pressure.

15. The fluid compressor as set forth in claim 14 wherein said first element is a first, interior bellows member and said second element is a second, exterior bellows member, said first and second bellows members being concentric and interconnected to enclose a void therebetween.

16. A fluid compressor comprised of:

a hermetic shell having a suction pressure portion and a discharge pressure portion;

a first scroll member disposed in said suction pressure portion, said first scroll member having an end plate including a discharge aperture, an upstanding involute portion disposed on said end plate, and an annular upstanding drive stub on said end plate extending oppositely from said upstanding involute portion;

a second scroll member fixed in said suction pressure portion, said second scroll member having an end plate, an upstanding involute wrap disposed on said end plate for interleaving engagement with said upstanding involute wrap of said first scroll member;

means for biasing said first scroll member end plate toward said second scroll member end plate;

a motor disposed in said hermetic shell, said motor including a shaft having an eccentric crankshaft portion;

means for compliantly driving said first scroll member, said compliant drive means having an aperture for accepting said eccentric crankshaft portion, said compliant drive means further having a circular exterior rotationally interfitting said annular drive stub;

a frame in said hermetic shell, said frame dividing said suction pressure portion and said discharge pressure portion, said frame defining a pressure regulation chamber concentric with the shaft of said motor, said frame further defining an passage for flow communication from said pressure regulation chamber to said discharge pressure portion;

means for regulating fluid pressure in said chamber, said pressure regulating means intersecting said passage in said frame;

an annular seal element radially disposed about said concentric chamber between said first scroll member end plate and said frame for sealing said chamber so that said regulated fluid pressure acts upon said first scroll end plate to bias said first scroll member toward said second scroll member; and an annular biasing member between said annular seal element and said frame for biasing said annular seal element toward said first scroll member end plate.

17. The fluid compressor as set forth in claim 16 wherein said pressure regulation means is further comprised of a piston moveably disposed in said passage in said frame for variably sizing said passage to regulate the flow therethrough.

18. The fluid compressor as set forth in claim 17 wherein said piston is operably connected to a pressure differential responsive controller.

19. The fluid compressor as set forth in claim 18 wherein said pressure differential responsive controller is comprised of a first element responsive to discharge pressure and a second element responsive to suction pressure.

20. The fluid compressor as set forth in claim 19 wherein said first element is a first, interior bellows member and said second element is a second, exterior bellows member, said first and second bellows members being concentric and interconnected to define a void of variable volume therebetween, said volume being substantially evacuated.

21. The fluid compressor as set forth in claim 20 wherein the frame is further operative to support the motor within said hermetic shell.

22. The fluid compressor as set forth in claim 21 wherein the frame further includes a lubricant reservoir.

23. The fluid compressor as set forth in claim 22 wherein the frame further includes a lubricant metering aperture for metering flow communication of a lubricant from said lubricant reservoir to said suction pressure portion wherein said lubricant is entrained with the fluid.

24. The fluid compressor as set forth in claim 23 wherein said motor includes a stator and a rotor defining an annular space in which the lubricant is disentrained from said fluid and through which the disentrained lubricant flows to said reservoir.

25. The fluid compressor as set forth in claim 24 wherein the frame further includes means for bearing rotational motion of said drive shaft.

26. The fluid compressor as set forth in claim 25 wherein the frame further includes a lubricant passage from said lubricant reservoir to said bearing means.

27. A scroll compressor apparatus for compressing a fluid from a relatively lower suction pressure to a relatively higher discharge pressure, said scroll compressor comprised of:

a hermetic shell having a suction pressure portion and a discharge pressure portion;

an orbiting scroll member disposed in said suction pressure portion, said orbiting scroll member having an end plate, an upstanding involute portion disposed on said end plate, and a shaft on said end plate;

a fixed scroll member in said suction pressure portion, said fixed scroll member having an upstanding involute portion for interleaving engagement with said upstanding involute portion of said first scroll member;

a frame in said hermetic shell, said frame separating said suction pressure portion and said discharge pressure portion, said frame and said first scroll member further defining a pressure regulation chamber concentric with a portion of the shaft of said first scroll member and a pressure regulation passage communicating between said pressure regulation chamber and said discharge pressure portion;

a motor disposed in said discharge pressure portion;

means for compliantly driving said orbiting scroll member, said compliant drive means including a drive shaft in connection with said motor, said drive shaft having an eccentric crank portion with a crank stub, said compliant drive means further including a link in rotational engagement with said crank stub and said orbiting scroll member shaft;

a pressure regulation device having a piston moveably disposed in said regulation aperture, said pressure regulation device further including a first element exposed to discharge pressure and a second element exposed to suction pressure, said first element and said second element operably connected to said piston;

an annular seal element disposed about said concentric chamber between said first scroll member end plate and said frame; and an annular seal spring disposed in said annular groove for biasing said annular seal toward said first scroll member end plate.

28. The scroll compressor apparatus as set forth in claim 27 wherein the pressure regulation device is further comprised of an inner bellows and a concentric outer bellows, said bellows being secured to an inner end plate and an outer end plate, said outer end plate further including a piston rod for actuating said piston.

29. The scroll compressor apparatus as set forth in claim 27 wherein the pressure regulation device is further comprised of a member having a large diameter section and a relatively small diameter section.

30. A refrigeration system for circulating refrigerant in closed loop connection comprised of:

a condenser for condensing refrigerant to liquid form;

an expansion valve for receiving liquid refrigerant from said condenser and expanding the refrigerant;

an evaporator for receiving liquid refrigerant from said expansion valve and evaporating the refrigerant; and a compressor for receiving expanded refrigerant from said evaporator and compressing the refrigerant, said compressor comprised of:

a hermetic shell;

a first scroll member disposed in said hermetic shell, said first scroll member having an end plate, said end plate defining a discharge aperture, an upstanding involute portion disposed on said end plate, and a drive stub on said end plate;

a second scroll member fixed in said hermetic shell, said second scroll member having an end plate and an upstanding involute portion disposed on said end plate for interleaving engagement with said upstanding involute portion of said first scroll member;

means for compliantly driving said first scroll member, said compliant drive means including a drive shaft having an eccentric crank portion and a crank stub, and a link for engaging said first scroll member drive stub and said crank stub;

a motor disposed in said hermetic shell, said motor engaging said compliant drive means;

a frame in said hermetic shell, said frame dividing said hermetic shell into a suction pressure portion and a discharge pressure portion, said frame and said first scroll member end plate defining a pressure regulation chamber concentric with the drive shaft of said compliant drive means, said frame further including an passage for flow communication from said chamber to said discharge pressure portion;

means for regulating fluid pressure in said pressure regulation chamber, whereby a regulated fluid pressure acts upon said first scroll member end plate to bias said first scroll member toward said second scroll member;

an annular seal element disposed about said concentric chamber between said first scroll member end plate and said frame for sealing said chamber so that said regulated fluid pressure acts upon said first scroll end plate to bias said first scroll member toward said second scroll member; and means for biasing said annular seal toward said first scroll member end plate.

31. The fluid compressor as set forth in claim 30 wherein said fluid compressor further includes means for biasing said first scroll member comprised of an annular biasing member.

32. The fluid compressor as set forth in claim 31 wherein said annular biasing member is further comprised of an annular spring.

33. The fluid compressor as set forth in claim 32 wherein said frame further defines an annular groove for containing said annular biasing member and at least a portion of said annular seal element.

34. The fluid compressor as set forth in claim 33 wherein the frame is further operative to support the motor within said hermetic shell.

35. The fluid compressor as set forth in claim 34 wherein the frame further includes a lubricant reservoir.

36. The fluid compressor as set forth in claim 35 wherein the frame further includes a lubricant metering aperture for metering flow communication of a lubricant from said lubricant reservoir to said suction pressure portion wherein said lubricant is entrained with the fluid.

37. The fluid compressor as set forth in claim 36 wherein said motor includes a stator and a rotor defining an annular space in which the lubricant is disentrained from said fluid and through which the disentrained lubricant flows to said reservoir.

38. The fluid compressor as set forth in claim 37 wherein the frame further includes means for bearing rotational motion of said drive shaft.

39. The fluid compressor as set forth in claim 38 wherein the frame further includes a lubricant passage from said lubricant reservoir to said bearing.

40. The fluid compressor as set forth in claim 39 wherein said pressure regulating means is further comprised of a piston member movably disposed in said aperture in said frame for variably sizing said aperture to regulate the flow therethrough.

41. The fluid compressor as set forth in claim 40 wherein said piston is operably connected to a pressure differential responsive controller.

42. The fluid compressor as set forth in claim 41 wherein said pressure differential responsive controller is comprised of a first element responsive to discharge pressure and a second element responsive to suction pressure.

43. The fluid compressor as set forth in claim 42 wherein said first element is a first, interior bellows member and said second element is a second, exterior bellows member, said first and second bellows members being concentric and interconnected to enclose a void of variable volume.

* * * * *

UNITED STATES PATENT AND TRADEMARK OFFICE

CERTIFICATE OF CORRECTION

PATENT NO. : 4,928,503

DATED : May 29, 1990

INVENTOR(S) : Delmar R. Riffe

It is certified that error appears in the above-identified patent and that said Letters Patent is hereby corrected as shown below:

In The Claims:

Claim 1, Column 10, line 18, "disclosed" should be --disposed--.

Claim 1, Column 10, line 23, "disclosed" should be --disposed--.

Signed and Sealed this

Thirteenth Day of August, 1991

*Attest:*

HARRY F. MANBECK, JR.

*Attesting Officer*

*Commissioner of Patents and Trademarks*